US007794132B2

(12) United States Patent
Cunius

(10) Patent No.: US 7,794,132 B2
(45) Date of Patent: Sep. 14, 2010

(54) LIGHTING SYSTEM

(75) Inventor: Jeff R. Cunius, Ontario, CA (US)

(73) Assignee: Troy-CSL Lighting, Inc., City of Industry, CA (US)

( * ) Notice: Subject to any disclaimer, the term of this patent is extended or adjusted under 35 U.S.C. 154(b) by 0 days.

(21) Appl. No.: 11/600,015

(22) Filed: Nov. 14, 2006

(65) Prior Publication Data

US 2008/0112169 A1 May 15, 2008

(51) Int. Cl.
*H01R 33/00* (2006.01)
*F21V 1/00* (2006.01)
*H01B 7/08* (2006.01)

(52) U.S. Cl. ..... 362/648; 362/238; 362/239; 362/241; 362/391; 362/652; 362/656; 362/657; 362/658; 362/659; 439/111; 439/638; 439/239; 174/110 R; 174/110 SR; 174/113 R; 174/117 R; 174/117 FF

(58) Field of Classification Search ..... 362/391, 362/652–659, 648, 238–239, 241, 244, 246, 362/249, 252, 404, 407; 439/111, 638, 239; 174/110 R, 110 SR, 113 R, 117 R, 117 F, 174/117 FF See application file for complete search history.

(56) References Cited

U.S. PATENT DOCUMENTS 4,241,498 A * 12/1980 Brandeau ..... 29/861
4,514,791 A * 4/1985 Tokieda ..... 362/249
5,027,262 A * 6/1991 Freed ..... 362/249
5,206,799 A * 4/1993 Tiesler ..... 362/296
5,321,593 A * 6/1994 Moates ..... 362/251
5,785,411 A * 7/1998 Komai et al. ..... 362/219
6,273,587 B1 * 8/2001 Demshki ..... 362/249
6,971,767 B2 * 12/2005 Agabekov et al. ..... 362/249
7,160,140 B1 * 1/2007 Mrakovich et al. ..... 439/417
2007/0053209 A1 * 3/2007 Uhler et al. ..... 362/648

* cited by examiner

*Primary Examiner*—Sandra L O'Shea
*Assistant Examiner*—Sean P Gramling
(74) *Attorney, Agent, or Firm*—Law Offices of Natan Epstein

(57) ABSTRACT

An electric lighting system for concealed lighting and track lighting installations has lamp holders spaced along a custom power cable with two finely braided high current conductors. The cable and conductors have a flattened rectangular cross section and are exceptionally pliable to facilitate cornering in tight spaces. The cable exterior is slotted for reduced height of the installed lamp holders and optimum low profile of concealed lighting installations. The lamp holders are adaptable to different types of lamps and include an optional reflector. Snap-on mounting lugs permit installation of the cable and lamp holders directly to a mounting surface. Alternatively, a low profile track holds the cable and lamp holders.

11 Claims, 18 Drawing Sheets

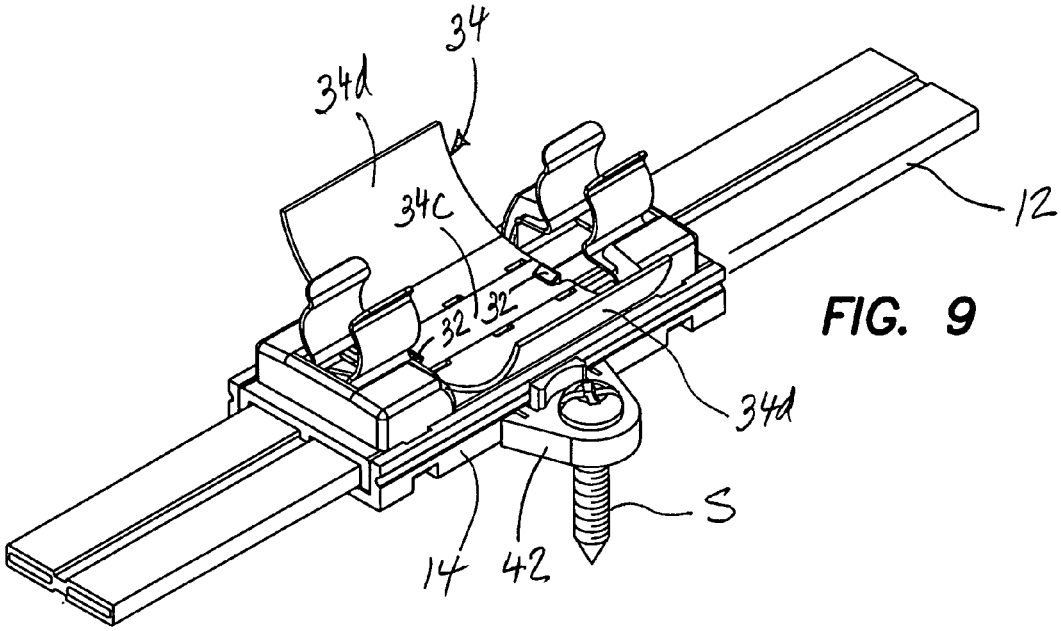
FIG. 9
FIG. 10
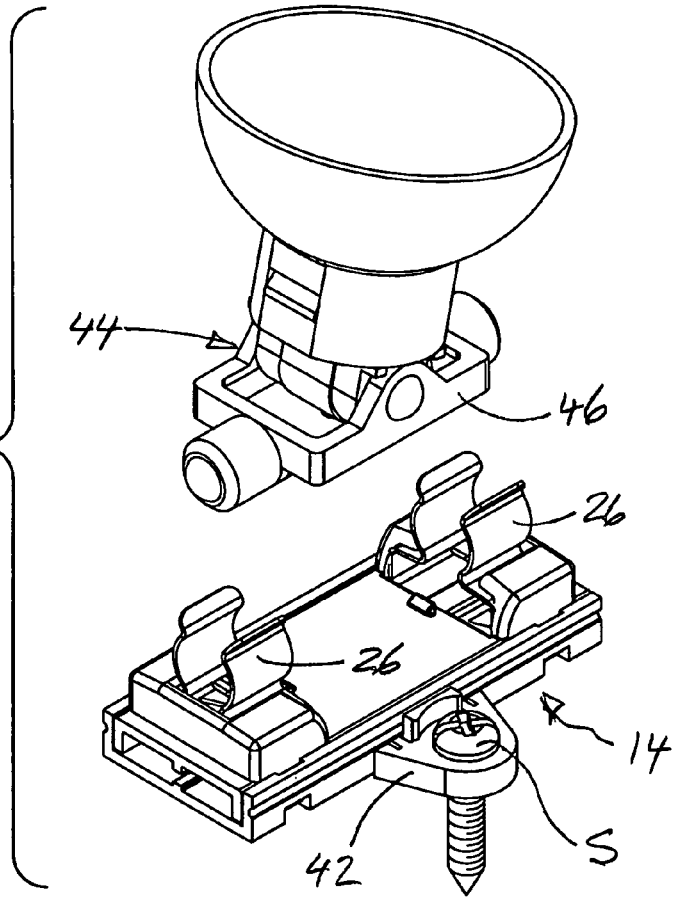

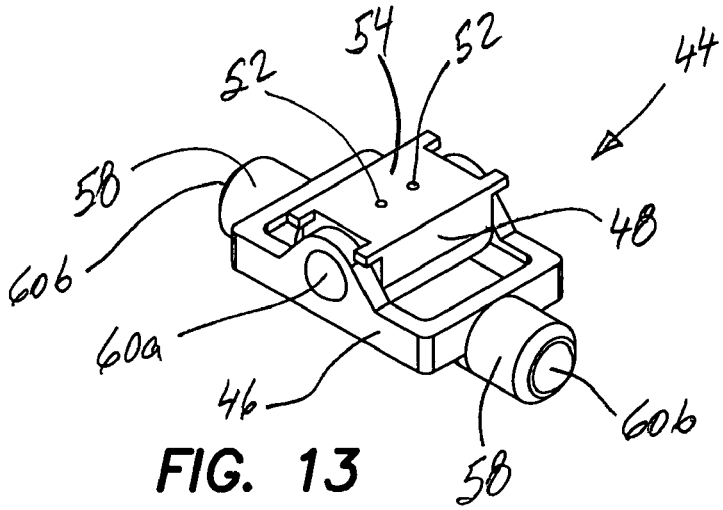
FIG. 13
FIG. 14
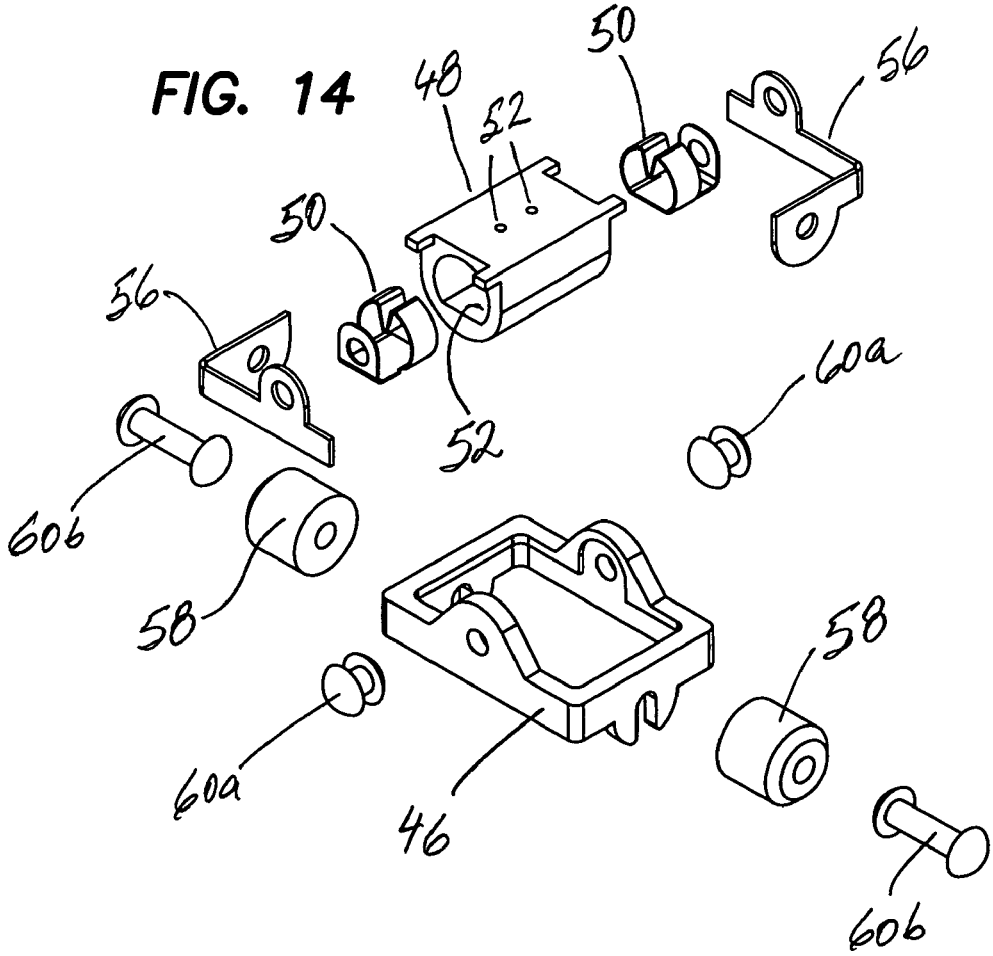

FIG. 15
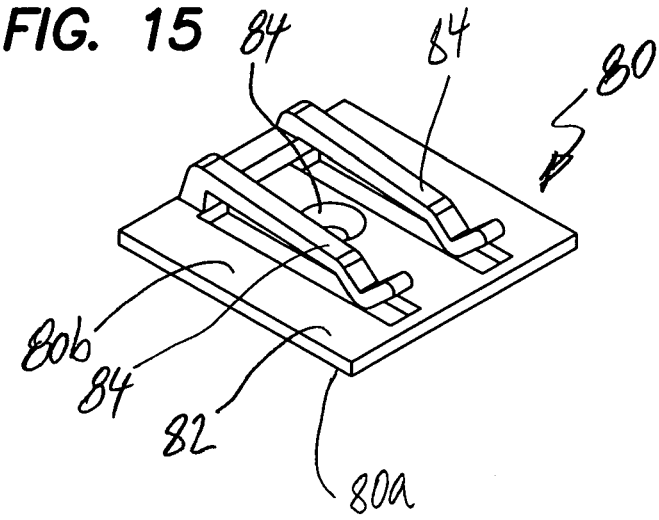
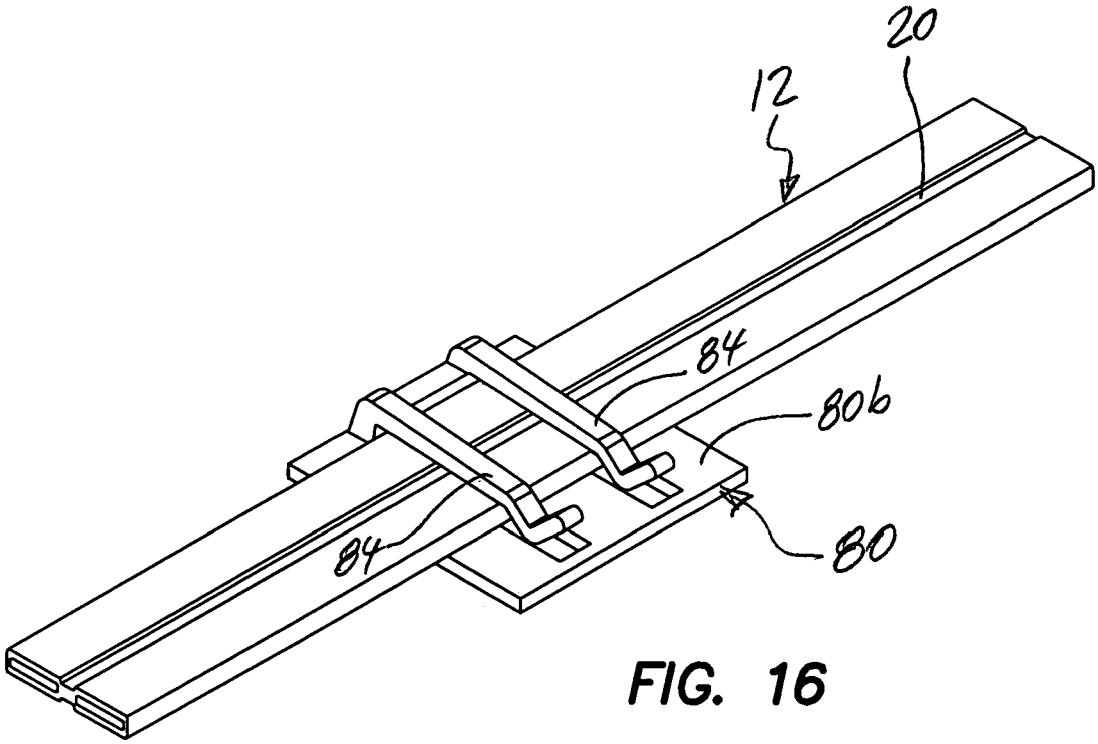
FIG. 16

96'
14
15
92'
92a
90
94
90'
26
28

96
26
14
15
92
92a
90
98
94
W
S

LIGHTING SYSTEM

BACKGROUND OF THE INVENTION

1. Field of the Invention

This invention pertains to the field of electric lighting and more specifically relates to a modular lighting system suitable for track mounting or trackless installation, for example, as concealed strip lighting in wall sconces and the like.

2. Background of the Invention

Track lighting and strip lighting is widely used, particularly in commercial settings, and many fixtures and modular systems of that type are available. Nonetheless, improvement is desirable in several aspects of those lighting systems.

SUMMARY OF THE INVENTION

An electric lighting system is disclosed having a power distribution cable with two braided conductors covered in an electrically insulating jacket and lamp sockets spaced along the cable in electrical contact with the conductors for supplying electrical power to a lamp installed in each socket. The cable has a generally rectangular cable cross section with a cable width greater than the cable thickness.

The power cable has braided conductors each of generally rectangular conductor cross section, and the braided conductors are flat rope braided with multiple braids each having multiple strands. In a presently preferred cable each conductor has about seven braids of about twenty four strands each, and each of the two conductors is braided with about 168 strands of 0.005 inch diameter copper. The preferred cable width is approximately 0.6 inches and the cable height approximately 0.1 inches. The conductors have a conductor width of about 0.1350 inches and a conductor height of approximately 0.05 inch, the conductor width being parallel to the cable width and transverse to the cable height.

The insulation defines a cable top and a cable bottom and a longitudinal slot of generally rectangular cross section in each of the top and the bottom, such that the cable in cross section also resembles two rectangles with rounded corners joined along adjacent short sides by a narrow bridge. The insulation may be of relatively soft and pliable, self healing polyvinylchloride (PVC).

The cable is pliable such that it can be bent or folded tightly to make an L shaped corner bend for following corners while keeping the cable generally flat on either side of the corner. The L shape can be made by twisting the cable from a flat condition on either side of the corner from a flat condition through approximately a forty five degree angle to a make a corner fold. Alternatively an L turn can be made by folding the cable over itself along a diagonal fold line.

Each lamp socket has a socket top and a socket bottom adapted to make interlocking engagement with each other for capturing the cable therebetween. The socket top and the socket bottom each have a center ridge or boss shaped to mate into the longitudinal center slot in the cable top and the cable bottom respectively.

The socket bottom has two socket sides and the socket top is seated onto the socket bottom between the socket sides and is fastened thereto by interlocking portions integral to the socket top and the socket bottom. Lamp contacts supported on the socket top have piercing prongs projecting beneath the socket top for penetrating the insulating jacket and making electrical contact with the parallel conductors of the captive cable. Each piercing prong preferably penetrates the cable near the center of a corresponding one of the conductors. The lamp contacts are adapted and configured for receiving the opposite end contacts of a festoon type double ended tubular lamp with a lamp axis held between the lamp contacts in generally parallel relation to the power distribution cable. The socket top is molded of thermoplastic material with two integrally formed contact holders for receiving and supporting the lamp contacts.

A heat shield is retained to the socket top between the contact holders. The heat shield may be a metal plate retained by top prongs integral with the socket top. A light reflector, such as a parabolic light reflector, may be interchangeable with the heat shield on the socket top. The light reflector may be curved only in a direction transverse to the lamp socket and may be selectively weakened along break-away lines for facilitating separation of either of two reflector wings from a reflector center, the reflector center being retained to the socket top by the top prongs.

A mounting lug is adapted to make snap retentive engagement with each lamp socket, with a hole in the lug for passing a fastener such as a wood screw, such that each lamp socket can be secured to a mounting surface, such as a wall or ceiling, by the fastener passing through the hole in a corresponding lug.

The lamp contacts on each lamp socket are configured for receiving a festoon type lamp with festoon contacts at opposite ends of a generally cylindrical lamp body. An adapter is provided for installing in the festoon lamp socket an MR type lamp having parallel pin contacts extending from a lamp base. The adapter has a frame having a longitudinal axis and a transverse axis, the frame being supported along its longitudinal axis between a pair of festoon contacts, a lamp holder on the frame, a pair of conductive clip inserts fitted in clip receptacles defined in the lamp holder, pin holes in the lamp holder communicating the clip receptacles to a lamp seat surface on the lamp holder such that lamp pins inserted in the pin holes come into electrical contact with the clip inserts, the clip inserts supporting the lamp holder to the frame for pivotal movement about the transverse axis, and electrical connectors on the frame for interconnecting each clip insert to a corresponding one of the festoon contacts, such that electrical power is provided from the festoon contacts to lamp pins inserted in the pin holes. Preferably, the clip inserts are pivotable about a first pair of conductive rivets supported on the frame, the festoon contacts are fastened to the frame by a second pair of conductive rivets, and the electrical conductors comprise conductive strips between the first rivets and the second rivets. The lamp holder may be generally tubular and the clip receptacles are opposite ends of a bore through the lamp holder.

The adapter can be provided with a centrally apertured dished light shield having a rearwardly extending axial collar about its central aperture. A generally U-shaped clip is fitted about the lamp holder and has clip ends in releasable retentive engagement with the collar for attaching the collar to the lamp holder, such that a lamp may be inserted through the collar into the pin holes of the adapter without separating the shield from the lamp holder. The collar may be integrally formed with the dished light shield with diametrically opposed openings stamped out in the collar for admitting the clip ends of the clip into retentive engagement with the collar.

An end cap is provided for terminating and supporting an end of the power distribution cable. The end cap has a cap top and a cap bottom assembled to each other in releasable interlocking engagement for capturing therebetween the end of the cable. The cap top and cap bottom each have longitudinal center ridges or bosses configured to mate into the longitudinal center slot in the cable top and the cable bottom respectively. The cap bottom has cap bottom side walls and the cap top is seated on the cap bottom between the cap bottom side walls and is fastened thereto by interlocking portions integral to the cap top and the cap bottom. The interlocking portions may include tabs on the cap top engageable in corresponding tab slots defined in the cap bottom. Preferably, the cap top and the cap bottom each have three side walls and an open side, the three side walls of the cap top are received between the three side walls of the cap bottom in the assembled condition of the end cap with the cable end captive therebetween. A mounting lug is adapted to make snap retentive engagement with the end cap, preferably with the cap bottom, such that the end cap may be fastened to a mounting surface by a fastener passing through a hole in the lug. The mounting lug may have lug prongs engageable in a slot defined in the cap bottom for making snap retentive engagement with the end cap. The same mounting lugs may be used for mounting both the lamp sockets and the end cap.

Mounting clips are provided for supporting the power cable to a mounting surface at locations spaced from lamp sockets. The mounting clip has a clip plate with a contact side for placement against a mounting surface, at least one and preferably two clip arms on an opposite side of the clip plate, and a hole for passing a mounting fastener through the plate. A contact adhesive may be provided on the contact side of the plate, for example for holding the mounting clip on the mounting surface while a fastener is installed through the plate.

As an alternative to use of mounting lugs or mounting clips to hold the cable and attached sockets to a mounting surface, a track is provided with two track side walls and a track bottom. The track is attached to a mounting surface with track fasteners such as screws passing through holes spaced along the track bottom. The track receives the power cable and interlocks with lamp sockets inserted between the track side walls. A side ridge along each side wall of the track fits into side grooves formed in each lamp socket to make snap retentive engagement for holding the lamp socket in the track. The track may be an extrusion of plastic or other suitable material, and a translucent or transparent lens such as a prismatic lens can be installed over the track as by snap interlock with the sides of the track.

In one form of the invention a wire guide is provided on an outer side of each of the track side walls for guiding additional single conductor insulated electrical wires along the sides of the track. The wire guides may be integral with the track, for example, extruded integrally with the track. The wire guides are each shaped for holding captive an electrical wire against a mounting surface underlying the track bottom.

These and other features, improvements and advantages of the present invention will be better understood by reference to the following detailed description of the preferred embodiments and the accompanying drawings.

BRIEF DESCRIPTION OF THE DRAWINGS

FIG. 9 is a view as in FIG. 7 but showing the parabolic reflector installed on the lamp socket and the lamp socket installed on the power cable;

FIG. 10 shows the festoon type lamp socket as in FIG. 7 and, in exploded relationship, an MR lamp adapter with light shield for the festoon lamp socket;

FIG. 13 is a perspective view of the MR lamp adapter of FIG. 10;

FIG. 14 is an exploded perspective view of the MR lamp adapter of FIG. 13;

FIG. 15 is a perspective view of the cable mounting clip according to this invention:

FIG. 16 is a perspective view showing the cable mounting clip of FIG. 15 holding the power cable;

DETAILED DESCRIPTION OF THE PREFERRED EMBODIMENTS

Figure 1:
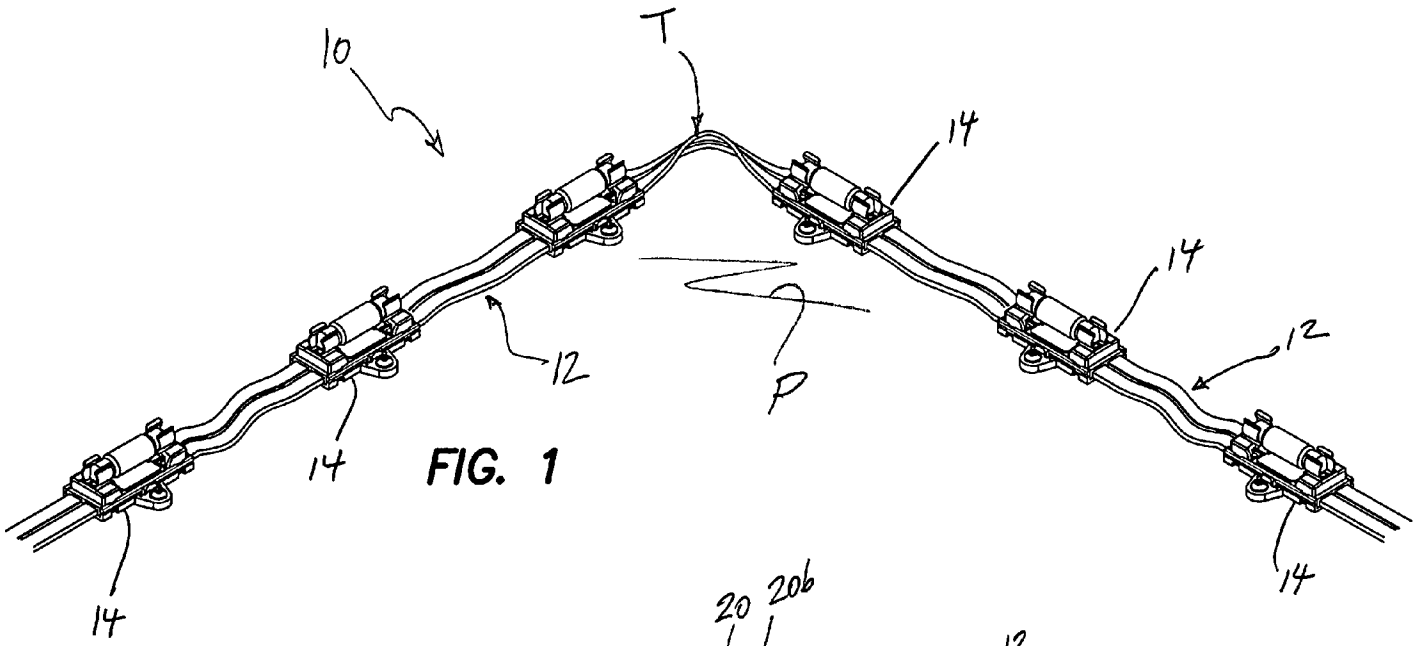
FIG. 1 shows in perspective view a length of strip lighting according to this invention with the power cable bent to make an L shaped turn.

With reference to the drawings wherein like elements are designated by like numerals, FIG. 1 shows a length of strip lighting generally designated by numeral 10 which has an electrical power distribution cable 12 and lamp sockets 14 spaced at regular intervals along cable 12.

Figure 2:
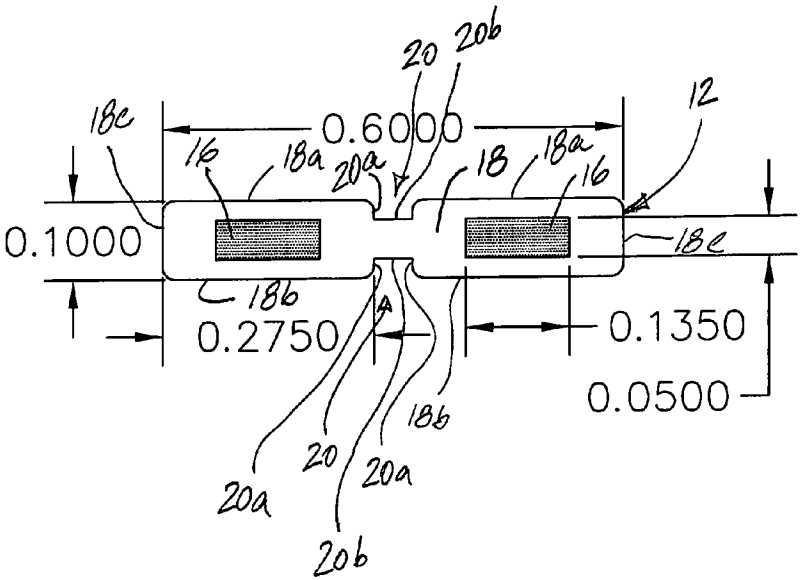
FIG. 2 is a cross section of the power cable of the strip lighting of FIGS. 1 and 1B.

FIG. 2 shows a cross section of the power cable 12, with two parallel electrical conductors 16 covered in electrical insulation 18. The cable insulation 18 is generally rectangular in cross section with a cable top 18*a*, a cable bottom 18*b* and two cable sides 18*c*. The cable top and cable bottom are planar and parallel to each other and are each divided by a longitudinal center slot 20. Slots 20 have a generally rectangular cross section with two slot walls 20*a* perpendicular to a slot bottom 20*b*. FIG. 2 shows the presently preferred dimensions of the power cable 20, with a small cable height of 0.1 inch relative to a greater width of 0.6 inch, yielding a relatively large width to height ratio. The insulation 18 has a minimum thickness of about 0.05 inch as measured between the bottoms 20*b* of the upper and lower slots 20, a slot depth of 0.025 inch and a slot width of 0.05 inch between slot walls 20*a*. The insulation is made of a relatively soft grade of polyvinylchloride, selected to be self healing when pierced.

The conductors 16 are rectangular in cross section. The preferred braiding is a flat rope braid using 0.005 inch diameter copper strands: with seven braids of twenty four strands each, such that each conductor 16 is braided with about 168 strands. The resulting stranded conductor is gauge equivalent to AWG 14. The braided conductors are hammered to the rectangular cross section from an initial round cross section of the rope braiding, and then covered with insulation 18. The conductors 16 have a conductor width of 0.1350 inch and a conductor height of 0.05 inch, as indicated in FIG. 2 of the drawings, or a ratio of approximately 2.7 times conductor width to conductor height. From the foregoing it will be evident that the cable also has a ratio of approximately 4.5 times conductor width to cable width, and a ratio of 2 times conductor height to cable height.

The resulting power cable 12 is pliable to a substantially greater degree than other power cable of comparable capacity used until now in strip lighting, and particularly more pliable than twin conductor cord having round insulation about each conductor. The power cable 12 can be easily bent to make relatively tight small radius corner turns and folds.

FIG. 1 shows cable 12 bent into a right angle turn or L shaped turn, designated by the letter "T", over a relatively short length of cable 12 between two adjacent lamp sockets 14. Significantly, the cable 12 under each of the sockets 14 immediately adjacent to the turn T lies flat on an underlying mounting surface. This is important since each socket is fastened to the mounting surface as will be explained below. Also, the short length of cable 12 required for making the turn T is significant because the strip lighting 10 is in part sold in prefabricated lengths of cable with lamp sockets 14 installed on the cable 12 at regular intervals, such as 3 inch, 6 inch and 10 inch spacing between sockets 14. Since the sockets are all pre-installed on one side of the cable 12, the same side of the cable must be flat against the common mounting surface on either side of the turn T, and as the available length of cable 12 between the adjacent sockets 14 can be small, the pliability of cable 12 facilitates installation of the strip lighting 10. In conventional strip lighting using heavy gauge round power cord it is frequently necessary to cut and splice the power cord to make tight turns because the cord cannot be bent or folded to a sufficient degree.

Figure 1A:
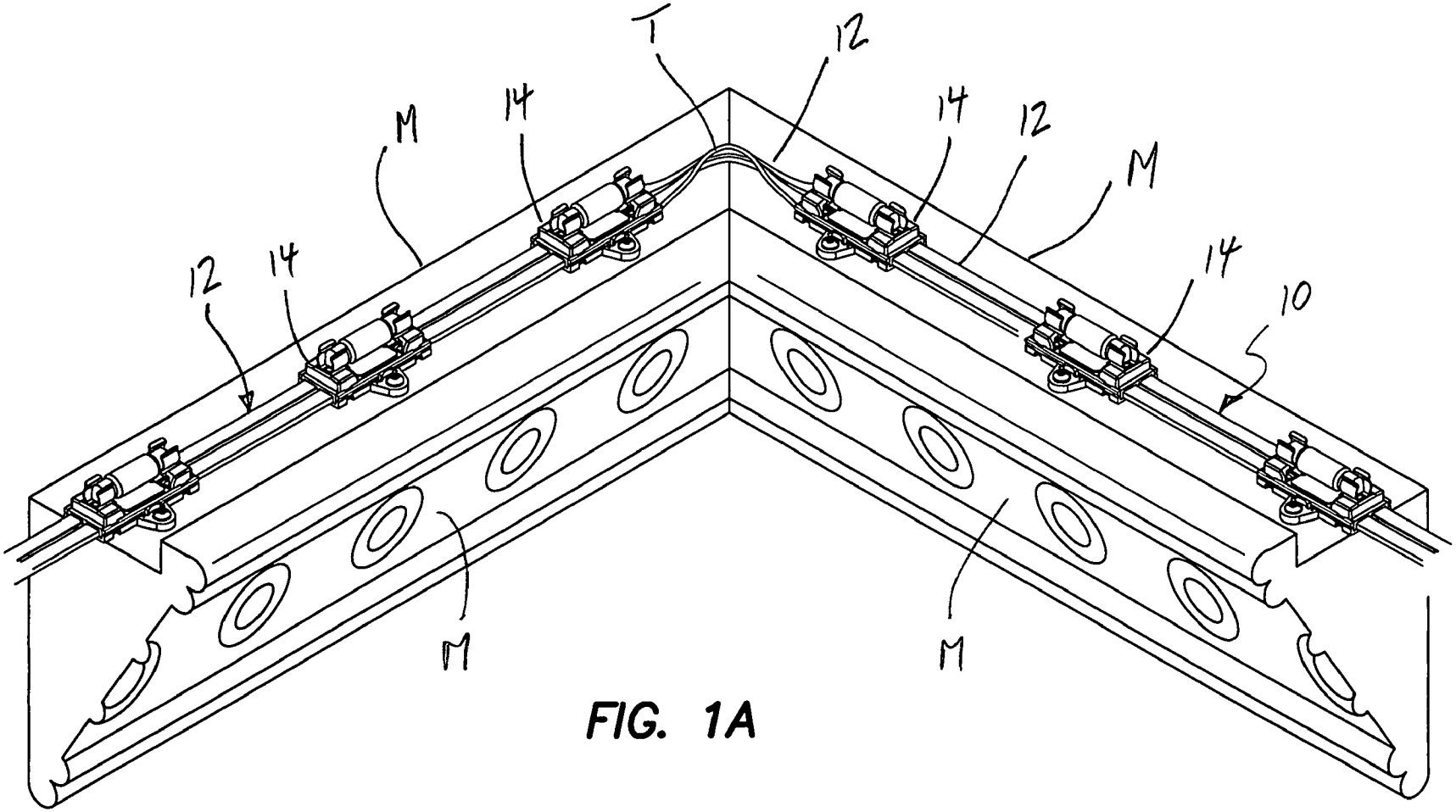
FIG. 1A shows a typical concealed lighting installation using the strip light of FIG. 1.
Figure 1B:
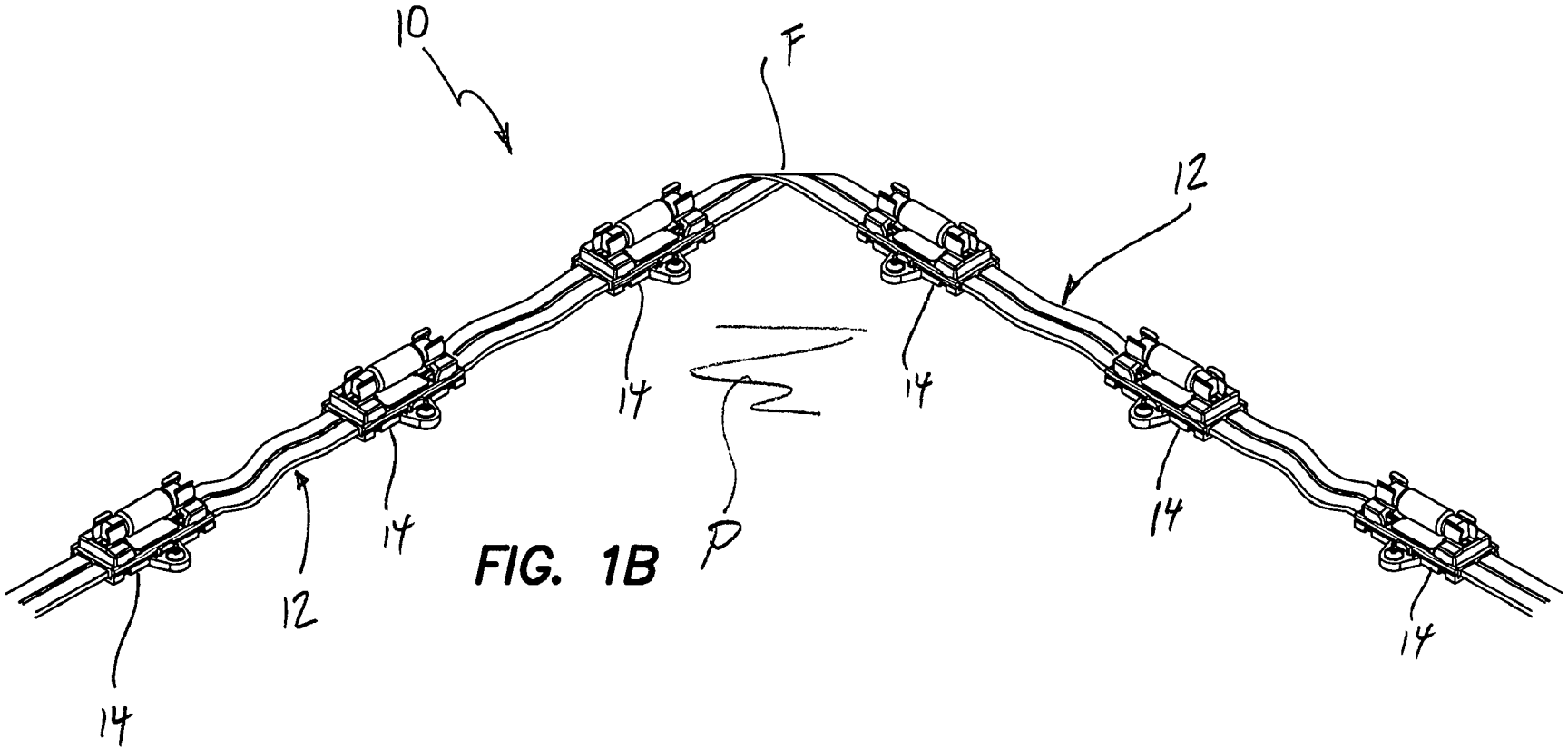
FIG. 1B shows a strip lighting section as in FIG. 1 but with the power cable folded over itself to make an L turn.
Figure 1C:
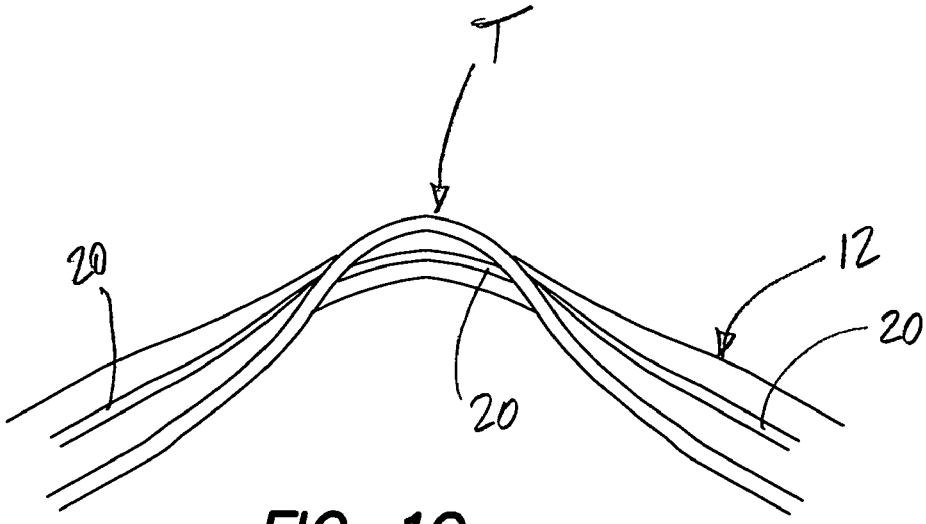
FIG. 1C is an enlarged fragmentary view of the bend in the power cable of FIG. 1.

In FIG. 1 the L shaped turn T is made by twisting the cable 12, from an initially flat condition on an underlying supporting plane P supporting the cable 12 and lamp sockets 14, through about a 45 degree twist along the cable on each side of the turn so as to form a relatively sharp bend B with an imaginary bend line b-b across the cable 12, so that the bend line lies at approximately a 45 degree angle to the plane P of the initially flat cable 12, as best seen in FIG. 1C. This type of turn or bend T is suitable for the prefabricated strip lighting 10 because all sockets 14 are preinstalled on one side of the cable 12 and the same side of the cable stays up on each side of the turn FIG. 1A illustrates how the tight turn T of the strip lighting 10 benefits a concealed lighting installation recessed in a narrow cove molding M.

Figure 1D:
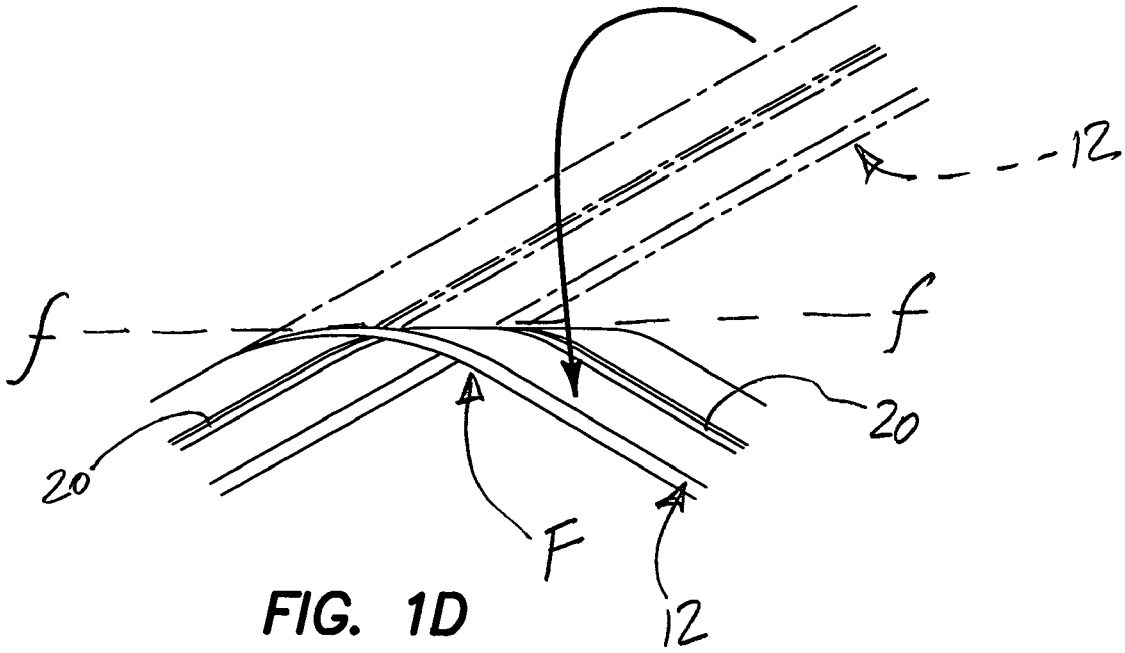
FIG. 1D is an enlarged fragmentary view of the fold in the power cable of FIG. 1B.

FIG. 1B shows a right angle turn or L shaped fold, designated by the letter "F", made by folding cable 12 over itself along a diagonal fold line f-f as best seen in FIG. 1D. This kind of cable fold is useful in cases where the cable 12 and lamp sockets 14 are purchased "loose" by an end user and the fold line f-f can be located along the cable before the lamp sockets 14 are assembled to the cable, so that sockets can be mounted on different upper facing sides of the cable 12 on each side of the fold F.

Figure 3:
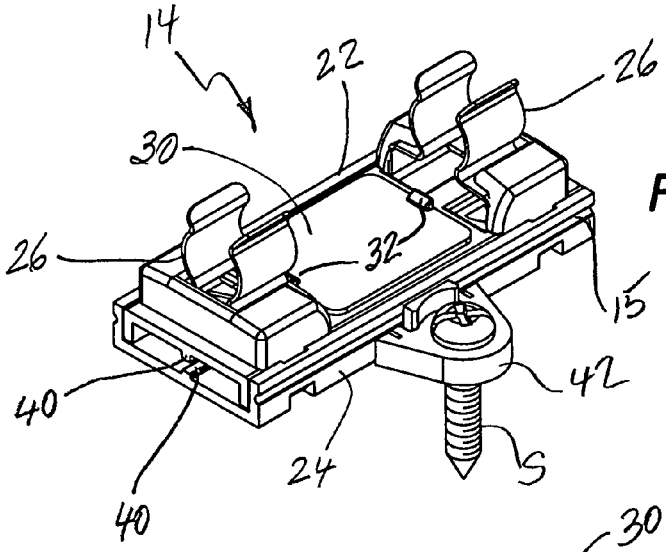
FIG. 3 is a perspective view of a festoon type lamp socket with assembled mounting lug and screw fastener.
Figure 4:
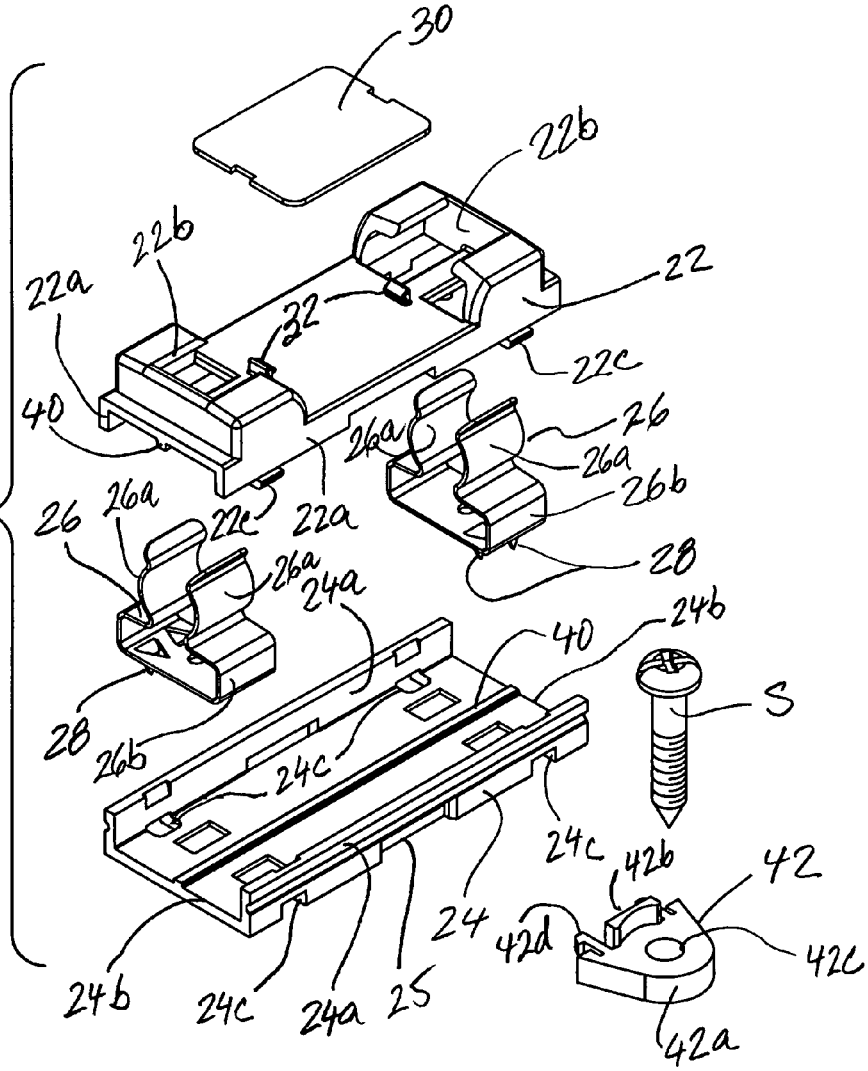
FIG. 4 is an exploded view of the lamp socket, mounting lug and screw fastener of FIG. 3.
Figure 5:
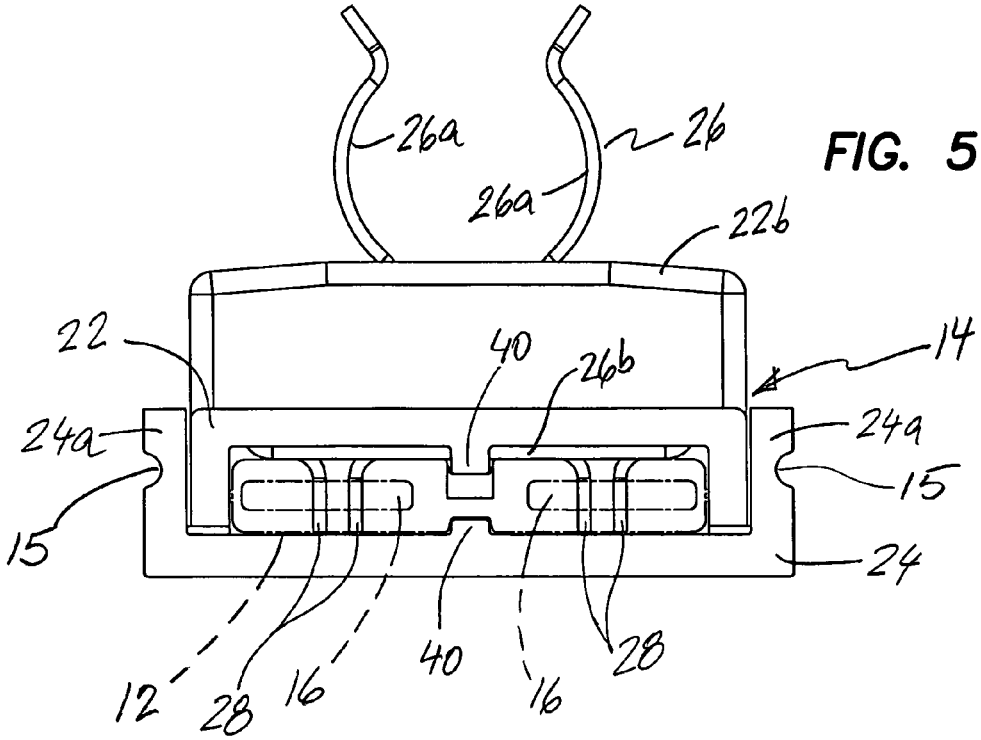
FIG. 5 is an end view of the lamp socket of FIG. 3 shown installed on the power cable, the latter suggested in phantom lining.

FIGS. 3 and 4 show a lamp socket 14 having a socket top 22 and a socket bottom 24 adapted to make interlocking engagement with each other for capturing the cable 12 therebetween, and lamp contacts 26 supported on the socket top 22 and which terminate in piercing prongs 28 projecting beneath the socket top. The piercing prongs 28 penetrate the cable insulation 18 of the captive cable 12 as best seen in FIG. 5 and make electrical contact with the parallel conductors 16, each piercing prong 28 preferably penetrating near the center of a corresponding one of the conductors 16. The conductors 16 are formed with a width greater than their height, as previously explained, to provide a greater piercing area to the piercing prongs 28. The socket top 22 and the socket bottom 24 each have a center ridge 40 or boss shaped to mate into the longitudinal center slot 20 in the cable top 18*a* and the cable bottom 18*b*, respectively, to help position the cable 12 in relation to the piercing prongs 28 and ensure electrical contact by the piercing prongs with conductors 16. The socket bottom 24 has two socket bottom side walls 24*a* and two open ends 24*b*. The socket top 22 has two socket top side walls 22*a* and is seated on the socket bottom 24 between the side walls 24*a*. The socket top is fastened to the socket bottom by interlocking portions 22*c*, 24*c* integral to the socket top and the socket bottom, respectively, namely, tabs 22*c* configured to snap into tab openings 24*c*.

Figure 6:
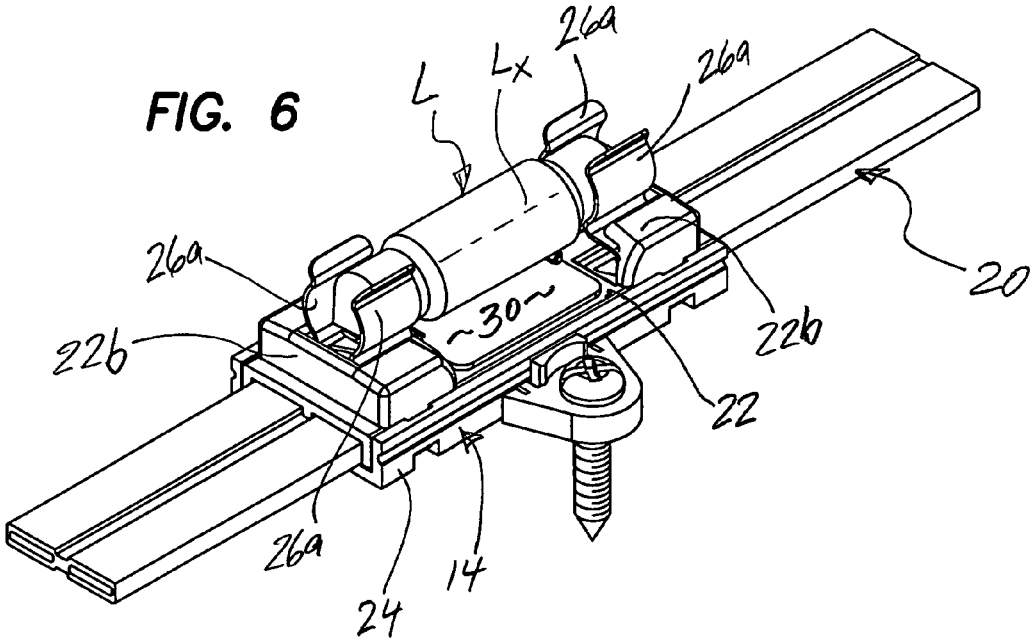
FIG. 6 is a perspective view of the festoon type lamp socket with assembled mounting lug and screw fastener of FIG. 3 shown installed on the power cable.

The lamp contacts 26 are adapted and configured for receiving the opposite end contacts Lc of a conventional festoon type double ended lamp L held of tubular configuration with a lamp axis Lx generally parallel to the power distribution cable 20, as shown in FIG. 6. The socket top 22 is molded of thermoplastic material with two integrally formed contact holders 22*b* for receiving and supporting the lamp contacts 26 with contact arms 26*a* projecting upwardly from the socket top and contact base 26*b* captive under the socket top 22 in contact holder 22*b*. A heat shield 30 is retained to the socket top 22 between the contact holders 22*b* under the central light emitting portion of the festoon: lamp L. The central portion of the lamp L typically becomes hottest and shield plate 30 protects the thermoplastic material of socket top 22 against excessive heating by dissipating heat over a larger area. The heat shield 30 may be a metal plate retained by top prongs 32 integral with the socket top 22.

Figure 7:
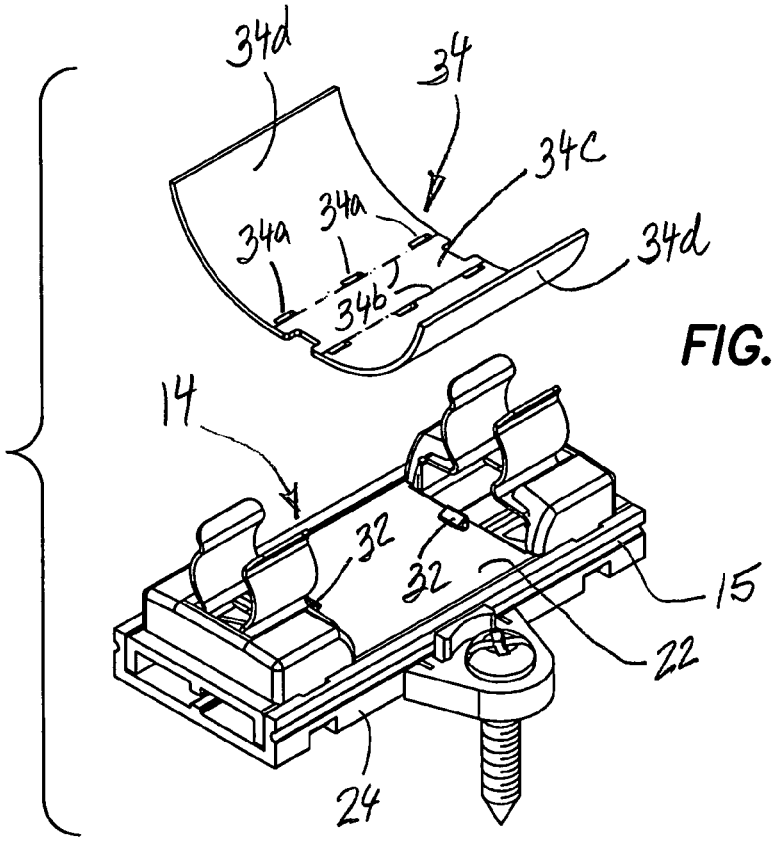
FIG. 7 shows the lamp socket as in FIG. 3 with a parabolic light reflector in exploded relationship to the socket as a replacement for the heat shield plate in FIG. 3.
Figure 8:
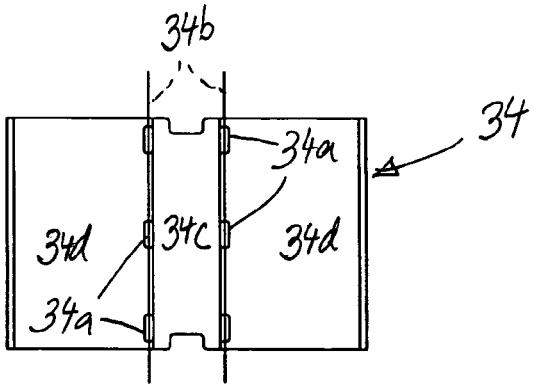
FIG. 8 is a top plan view of the parabolic light reflector of FIG. 7 with the two break-away lines suggested in dotted lining.
Figure 8A:
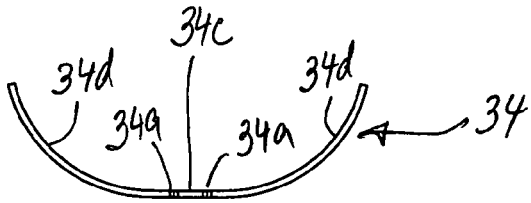
FIG. 8A is an end view of the parabolic light reflector of FIG. 7.
Figure 8B:
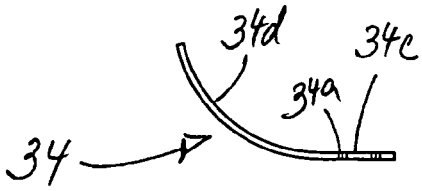
FIG. 8B is an end view of the parabolic light reflector of FIG. 7 with one wing of the reflector broken away.
Figure 11:
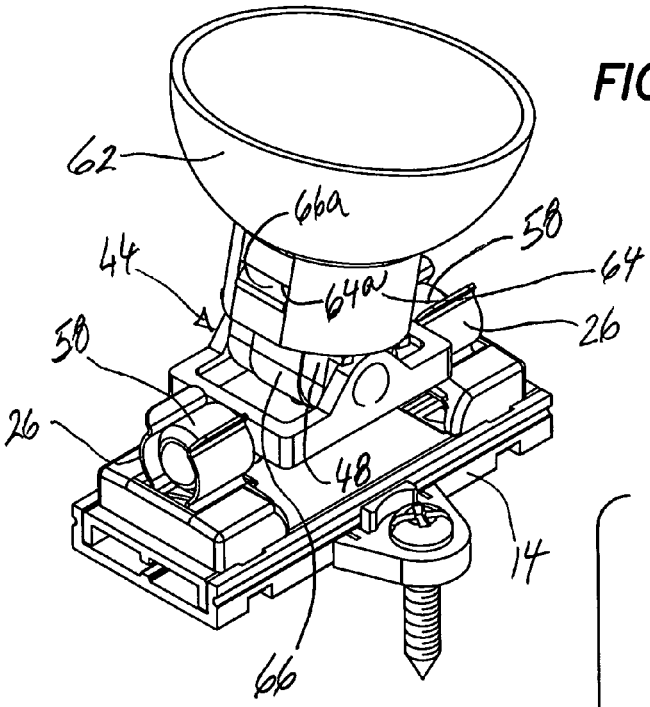
FIG. 11 is a view as in FIG. 10 showing the MR lamp adapter installed on the festoon type lamp socket.
Figure 12:
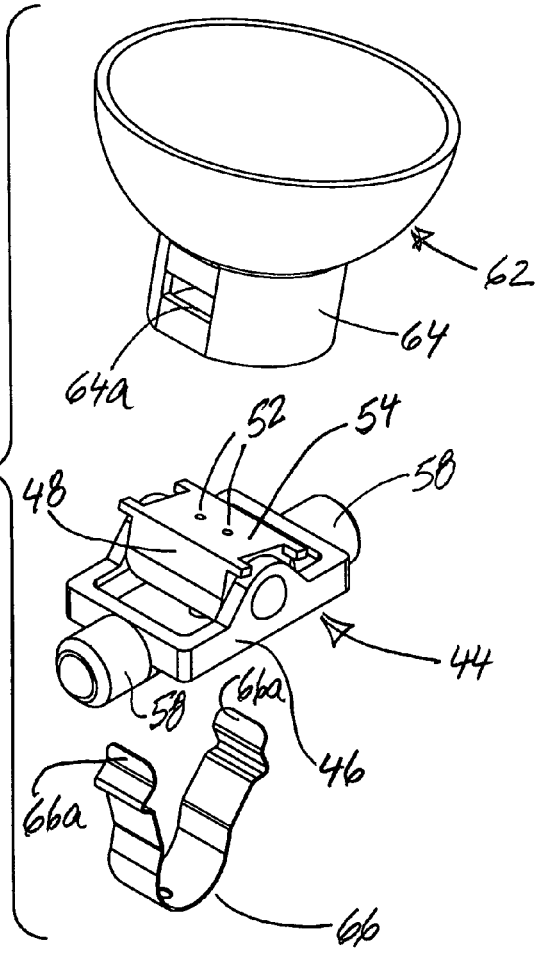
FIG. 12 is an exploded perspective view of the light shield and its retaining clip with the MR lamp adapter.

A light reflector, such as a parabolic light reflector 34 seen in FIGS. 7-8B, may be interchangeable with the heat shield 30 on the socket top. The light reflector 34 is flat in a longitudinal direction and is curved only in a direction transverse to the lamp socket 14. A series of rectangular holes 34*a* are punched in the reflector to selectively weaken the reflector along imaginary break-away lines 34*b* for facilitating separation of either of two reflector wings 34*d* from a reflector center 34*c*, the reflector center 34*c* being retained to the socket top 22 by the top prongs 32 in a manner analogous to retention of the heat shield plate 30 depicted in FIG. 3. Reflector 34 with both wings 34*d* generally directs light from lamp L in a beam away from the reflector center. FIG. 8B shows reflector 34 with one reflector wing 34*d* broken away from reflector center 34*c* resulting in more light being directed to one side of lamp L away from the remaining reflector wing 34*d*.

A mounting lug 42 is adapted to make snap retentive engagement with each lamp socket 14, as seen in FIGS. 3 and 4. Lug 42 is ear shaped with a rounded outer edge 42*a*, a flat inner edge 42*b* and a hole 42*c* through the lug for passing a fastener such as a wood screw S through the hole, such that each lamp socket 14 can be individually fastened to a mounting surface. Each lug 42 holds down a corresponding lamp socket 14 and the lugs collectively also support cable 12 running through the sockets 14.

The lamp contacts 26 on each lamp socket 14 are configured for receiving a festoon type lamp L which is a conventional lamp configuration characterized by a tubular overall shape with cylindrical metal contacts at opposite ends of a generally cylindrical glass body. In order to enable use of lamps other than festoon lamps in the lighting system 10, an adapter 44 is provided for installing an MR type lamp, also a conventional lamp configuration having parallel pin contacts extending from a lamp base. As seen in FIGS. 10-14 the adapter 44 has a frame 46 with a longitudinal axis and a transverse axis. Frame 46 is held between the festoon lamp contacts 26 of the lamp socket 14 along its longitudinal axis. Frame 46 supports a lamp holder 48 and a pair of conductive clip inserts 50 fitted in clip receptacles 52 defined in the lamp holder 48. Two pin holes 52 in the lamp holder 48 are open between and communicate the clip receptacles 52 to a lamp seat surface 54 on the lamp holder 48, such that lamp pins of an MR type bulb inserted in the pin holes 52 come into electrical contact with one end of the clip inserts 50. The clip inserts 50 serve as bearings to support the lamp holder 48 to frame 46 for pivotal movement about the transverse axis of the frame, and electrical connectors 56 are provided on the frame 46 for interconnecting each clip insert 50 to a corresponding one of the adapter's festoon contacts 58, such that electrical power is provided from the festoon contacts 58 to lamp pins inserted in the pin holes 52. The clip inserts 50 are pivotable about a first pair of conductive rivets 60*a* supported on the frame 46, the adapter festoon contacts 58 are fastened to the frame 46 by a second pair of conductive rivets 60*b*, and the electrical conductors 56 are conductive strips in connected by electrical contact between the first rivets 60*a* and the second rivets 60*b*. The lamp holder 48 is generally tubular with a flat lamp seat surface 54, and the clip receptacles 52 are opposite ends of a bore passing through the lamp holder 48.

The adapter 44 can be provided with a centrally apertured dished light shield 62, for example, an aluminum spinning with a rearwardly extending axial collar 64 about its central aperture. A generally U-shaped retaining clip 66 fits about lamp holder 48 and has clip ends 66*a* which make releasable retentive engagement with the collar 64 for holding the collar 64 to the lamp holder 48, such that the base of an MR type lamp may be inserted through the collar 64 onto the lamp seat surface 54 and the lamp pins inserted into pin holes 52 without separating the light shield 62 from the lamp holder 48. The collar 64 may be integrally formed with the light shield 62 and with diametrically opposed openings 64*a* stamped out in the collar 64 for admitting the clip ends 66*a* into the aforementioned retentive engagement.

Figure 17:
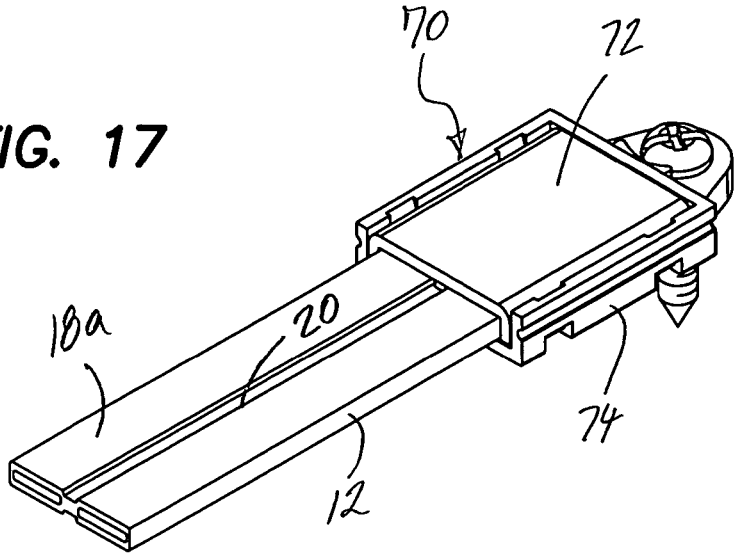
FIG. 17 is a perspective view of the end cap installed for terminating an end of the power cable and assembled to a mounting lug and screw fastener.
Figure 18:
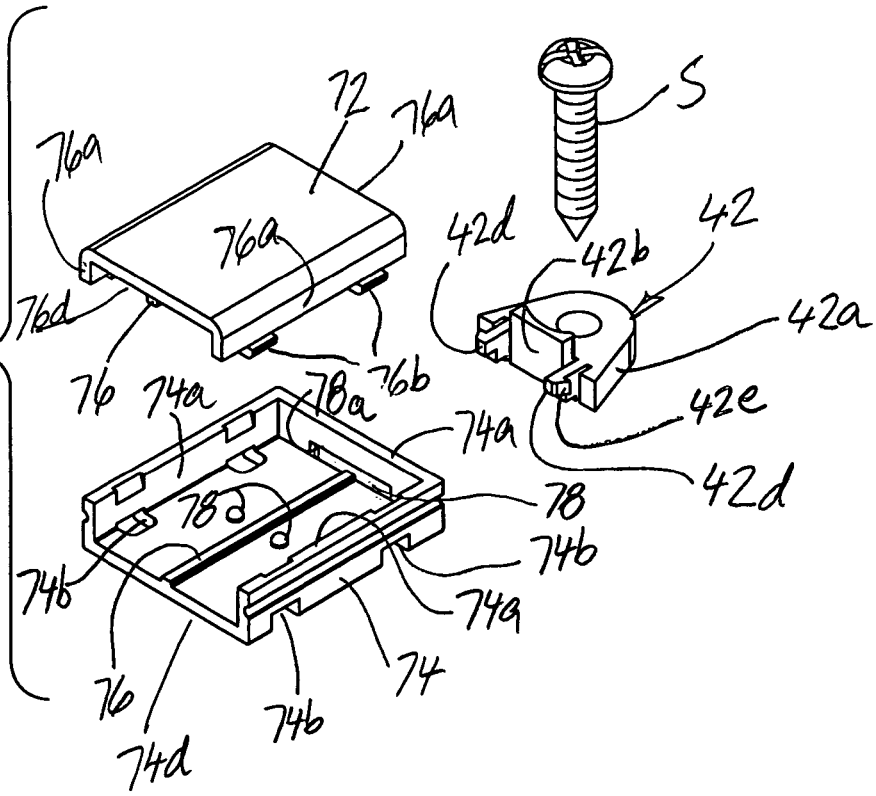
FIG. 18 is an exploded perspective view of the end cap, mounting lug and screw fastener of FIG. 17.

An end cap 70 shown in FIGS. 17 and 18 is provided for supporting and terminating an end of the power distribution cable 12. The end cap 70 has a cap top 72 and a cap bottom 74 assembled to each other in releasable interlocking engagement or snap lock assembly for capturing between them an end of the power distribution cable 12. The cap top 72 and cap bottom 74 each have a longitudinal center ridge 76 or boss configured to mate into the longitudinal center slot 20 in the cable top 1 Ba and the cable bottom 18*b* respectively.

The cap bottom 74 has two cap bottom sides 74*a* and the cap top 76 is seated onto the cap bottom 74 between the cap bottom sides 74*a* and is fastened thereto by interlocking portions integral to the cap top and the cap bottom. The interlocking portions may include tabs 76*b* on the cap top 76 engageable in corresponding tab slots 74*b* defined in the cap bottom 74. Preferably, the cap top 76 and the cap bottom 74 each have three sides 76*a*, 74*a* respectively and an open side 76*d*, 74*d*, respectively. The three sides 76*a* of the cap top 76 are received between the three sides 74*a* of the cap bottom 74 in the assembled condition of the end cap 72 shown in FIG. 17. The cable 12 enters the end cap 72 through the aligned open sides 76*d*, 74*d*. Raised bumps 78 on cap top and bottom press into the resilient insulation 18 of cable 12 and keep the cable end from being easily pulled out of the end cap 72.

A mounting lug 42 identical to the lug 42 used for mounting lamp sockets 14 above is adapted to make snap retentive engagement with the end cap 72 such that the end cap may be secured to a mounting surface by a fastener, such as wood screw S, passing through hole 42*c* in the lug. The lug 42 has two barbed lug prongs 42*d* engageable in a slot 78 defined in the cap bottom 74 for making snap retentive engagement with the assembled end cap 72. The lug prongs have cam surfaces 42*e* which are squeezed together by side edges 78*a* of the slot 78 when the prongs are pressed into the slot and then spring away from each other inside the cap 72 holding the lug 42 against the side 74*a* of the cap bottom. Engagement of lug 42 to lamp socket 14 is similar by engaging lug 42 In slot 25 provided in socket bottom 24.

One or more mounting clips 80 shown in FIGS. 15 and 16 may be provided for supporting the power distribution cable 12 to a mounting surface where support may be needed, for example at locations away from lamp sockets 14. The mounting clip 80 has a clip plate 82 having a contact side 80*a* for placement against a mounting surface, two clip arms 84 on an opposite side 80*b* of the clip plate, and a hole 84 for passing a mounting fastener such as a wood screw through the plate 82. A contact adhesive may be provided on the contact side 80*a* of the plate 82, to facilitate installation by holding the clip 80 on the mounting surface while a fastener is installed through the plate 82.

The strip lighting system 10 as described to this point makes use of mounting lugs 42 and possibly mounting clips 80 for fastening the cable 10 and lamp sockets 14 to a mounting surface. As an alternative, a track 90 is provided which can be fastened to a mounting surface for holding cable 12 and lamp sockets 14, as shown in FIGS. 26-28.

Figures 26, 27, 28:
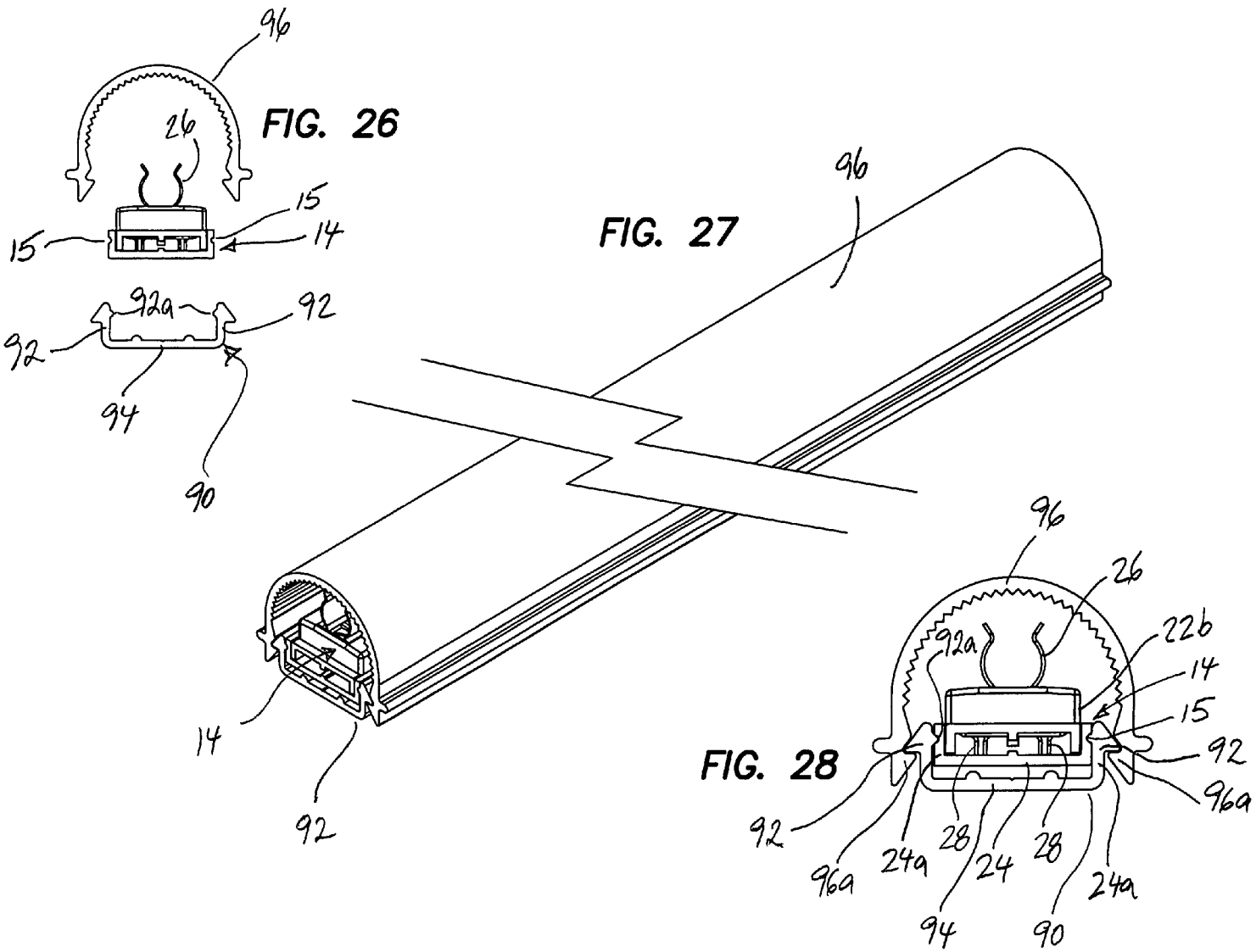
FIG. 26 is an exploded cross sectional view of a festoon lamp socket, track section and lens.
FIG. 27 Is an assembled perspective view of a track section with assembled lens and housing a length of strip lighting consisting of a power cable with lamp sockets installed on the cable at regular intervals.
FIG. 28 is an assembled cross sectional view of the festoon lamp socket, track section and lens of FIG. 26.

Turning to FIGS. 26-28 track 90 has two track side walls 92 and a-track bottom 94, and is attached to a mounting surface with track fasteners such as screws passing through holes spaced along the track bottom. Track 90 interlocks with and retains lamp sockets 14 inserted between the track side walls 92. A side ridge 92*a* along the interior of each track side wall mates with side grooves 15 formed on the outside of socket bottom side walls 24*a*, as best seen in FIG. 28. The lamp socket 14 makes snap retentive engagement in track 90 when pressed down into the track, to hold the lamp socket in the track. The track may be a continuous extrusion of plastic or other suitable material. A translucent or transparent lens 96 can be installed over the track 90, for example, also by snap interlocking of the lens edges 96*a* with the sides 92 of the track, as shown in FIG. 28.

Figures 29, 30, 31:
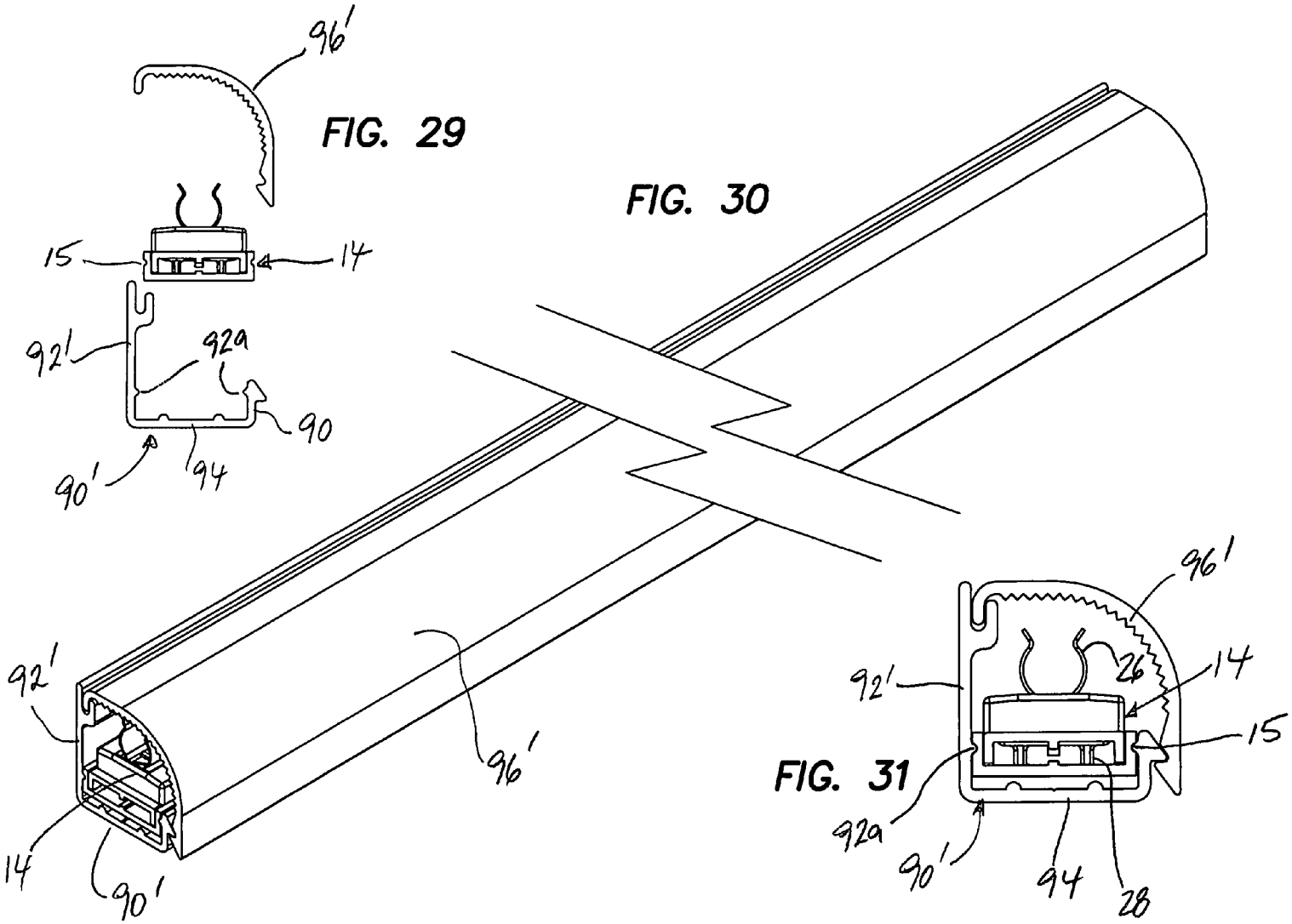
FIG. 29 is an exploded cross sectional view of a festoon lamp socket, wall wash type track section and lens.
FIG. 30 is an assembled perspective view of the wall wash track section with assembled lens and housing a length of strip lighting consisting of a power cable with lamp sockets installed on the cable at regular intervals.
FIG. 31 is an assembled cross sectional view of the festoon lamp socket, wall wash track section and lens of FIG. 29.

FIGS. 29-31 show an alternate track configuration 90' suitable for mounting along a wall for a wall light wash effect. Track 90' differs from track 90 in that one of the side walls 92 is taller than the other side wall and the lens 96' covers a 90° arc in cross section rather than approximately a 180° arc as in lens 96 of FIG. 28.

Figures 32, 33, 34:
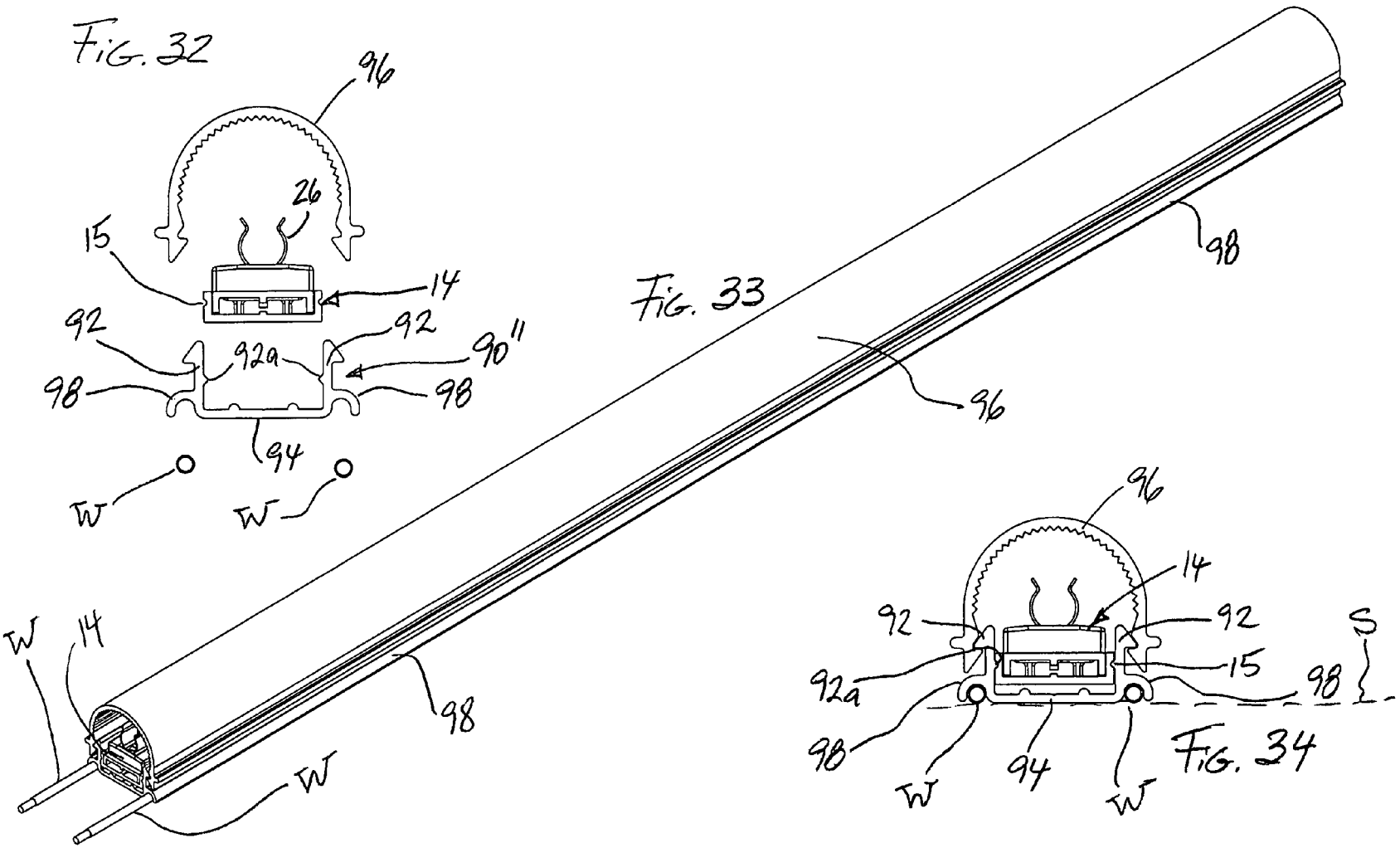
FIG. 32 is an exploded cross sectional view of a festoon lamp socket, chaser type track section and lens.
FIG. 33 is an assembled perspective view of the chaser type track section with assembled lens and housing a length of strip lighting consisting of a power cable with lamp sockets installed on the cable at regular intervals, and showing chaser wires along the outer sides of the track.
FIG. 34 is an assembled cross sectional view of the festoon lamp socket, chaser type track section with chaser wires and lens of FIG. 32.

FIGS. 32-34 show a chaser type track 90" similar to track 90 but provided with a chaser wire guide 98 on an outer side of each of the side walls 92 for guiding power supply chaser wires W along the outside of the track. The wire guides 98 are formed integrally with the track 90", for example, as integral part of a track extrusion. The chaser wire guides 98 have an arcuate, generally quarter circular cross section with a concave underside 98*a*, generally conforming to the cross sectional curvature of an insulated electrical chaser wire W, for holding and containing the wire under the wire guide 98 and against a mounting surface S underlying the track bottom 94. The chaser type track 90" is typically used in lighting installations where two consecutive track sections are powered by separate power transformers but both transformers are mounted at one end of track 90". A first power transformer supplies power to cable 12 of chaser track 90" and the exterior chaser wires carry electrical power from the second power transformer along track 90" to the second section of track which starts at the opposite end of the chaser track 90", where the exterior wires are connected to a cable 12 contained in the second section of track. This arrangement becomes necessary where the first section of track consumes the rated power output of one transformer and a second transformer is needed to power the second track section, but where for esthetic or practical considerations it is desirable to mount both transformers in one location at one end of the two continuous tracks.

Figure 19:
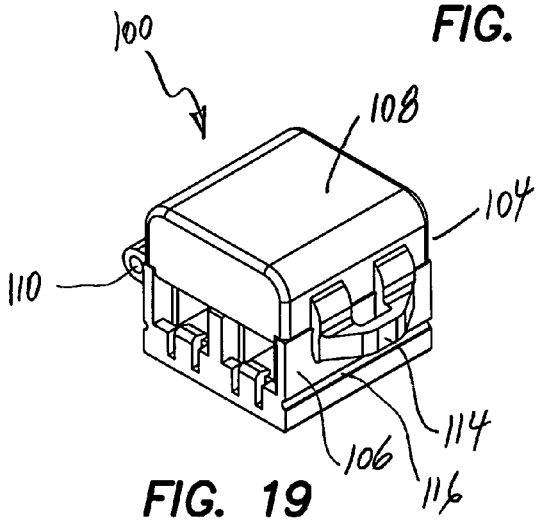
FIG. 19 is a perspective view of a terminal strip block for connecting the power cable to a pair of electrical supply wires.
Figure 20:
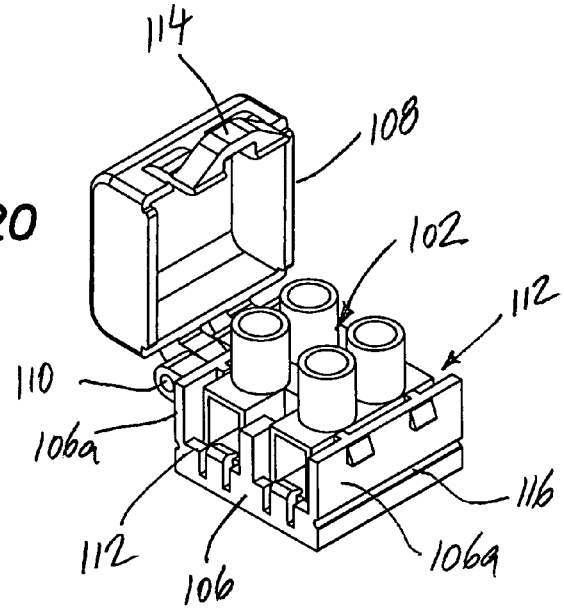
FIG. 20 is a view as in FIG. 19 showing the cover of the terminal strip block open for access to the terminal strip screws.
Figure 21:
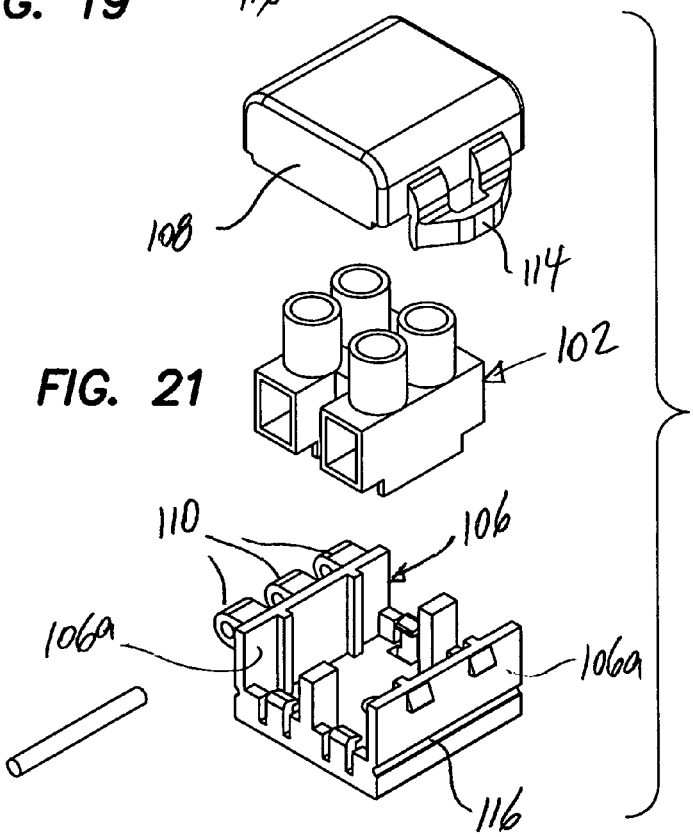
FIG. 21 is an exploded view of the terminal strip block of FIG. 19.

FIGS. 19-21 show a power block 100 where a conventional four-terminal screw-down terminal strip 102 is provided with a terminal strip housing 104. Housing 104 has a housing bottom 106 containing the terminal strip 102 and a housing cover 108 hinged at 110 to housing bottom 106. The housing bottom 106 has two housing bottom side walls 106*a* and two open ends 112 between side walls 106*a*. A clasp 114 is provided for fastening the housing cover 108 closed to housing bottom 106 as in FIG. 19. A pair of grooves 116 along the exterior of housing bottom side walls 106*a* are provided for making retentive engagement with side ridges 92*a* of track 90 so that the power block 100 can be snap mounted into the track 90 in a manner similar to the lamp sockets 14, as explained above. The power block 100 is used for making electrical power connections to and from power cable 12. One end of cable 12 is stripped to expose conductors 16 and each conductor 16 is inserted into a corresponding terminal on one open end 112 of power block 100. The conductors are fastened by tightening the corresponding two terminal screws of terminal strip 102. Two other wires, for example, two power carrying wires from a power transformer are inserted in the other two terminals on the opposite open end 112 and fastened there with the other two terminal screws. Terminal strip 102 is a commonly available item and its details are not shown in the drawings for simplicity.

Figure 22:
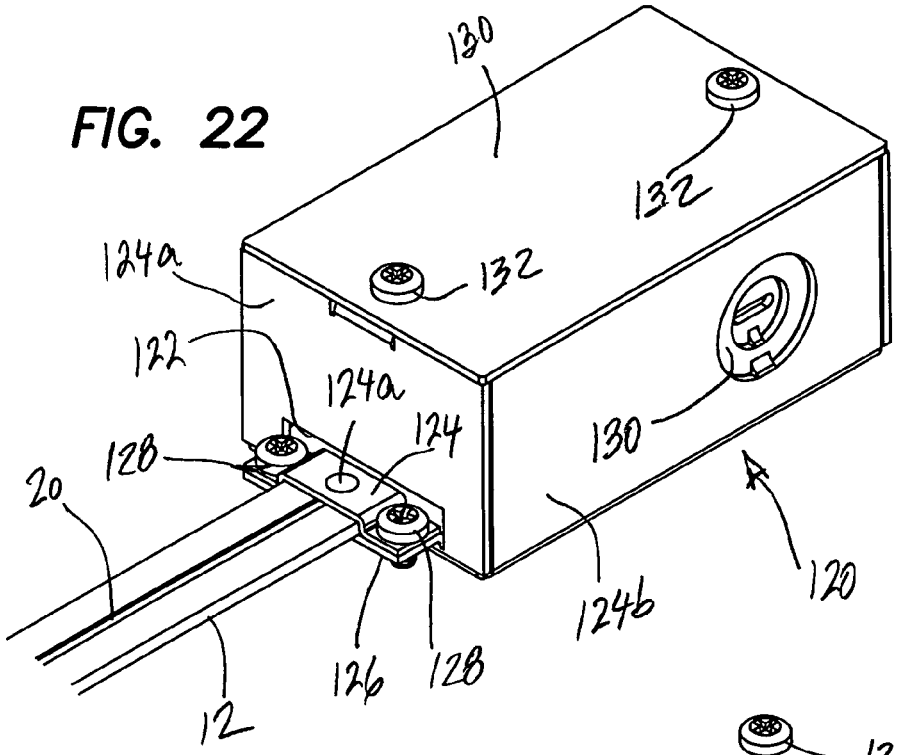
FIG. 22 is a perspective view of a junction box :assembled to an end of the power cable for splicing the power cable to a pair of electrical supply wires.
Figure 23:
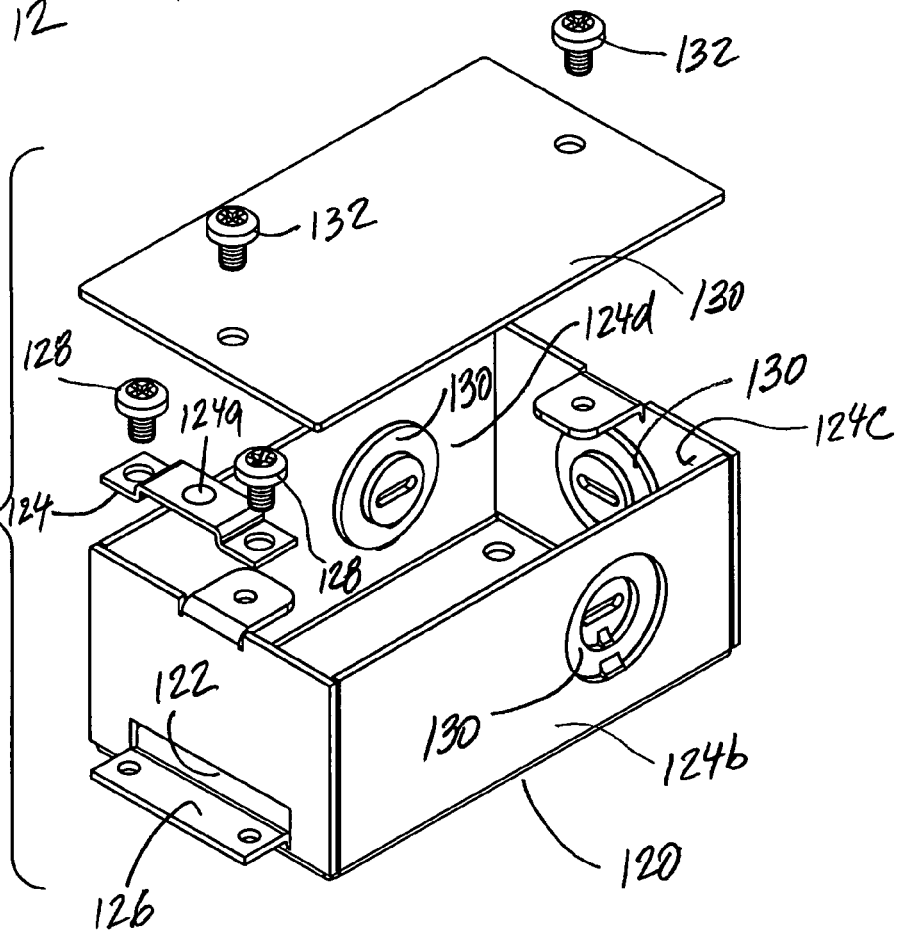
FIG. 23 is an exploded view of the junction box of FIG. 22.

FIGS. 22-23 show a junction box 120 used to splice electrical wires to cable 12. Box 120 has a slot 122 in one side 124*a* of the box for admitting and end of power cable 12. Cable 12 is clamped to the box between clamping bar 124 and lip 126 of the box 120. A dimple 124*a* in the clamping bar is pressed down against the cable insulation by clamp screws 128 threaded for urging the clamping bar 124 against lip 126. The junction box 120 has knockouts 130 in each of the three remaining sides 124*b,c,d* of the box for admitting electrical wires to be spliced to the end of cable 12 in the box. The box is closed by a box cover 130 fastened with two screws 132.

Figure 24:
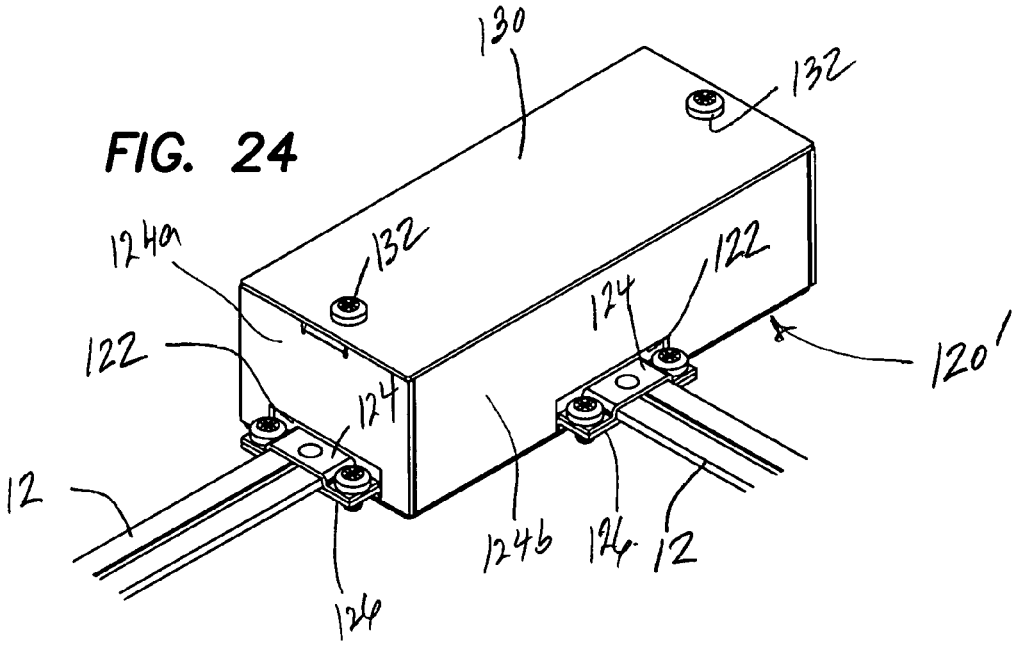
FIG. 24 is a perspective view of a junction box assembled to two cable ends for making an L splice between the cable ends.
Figure 25:
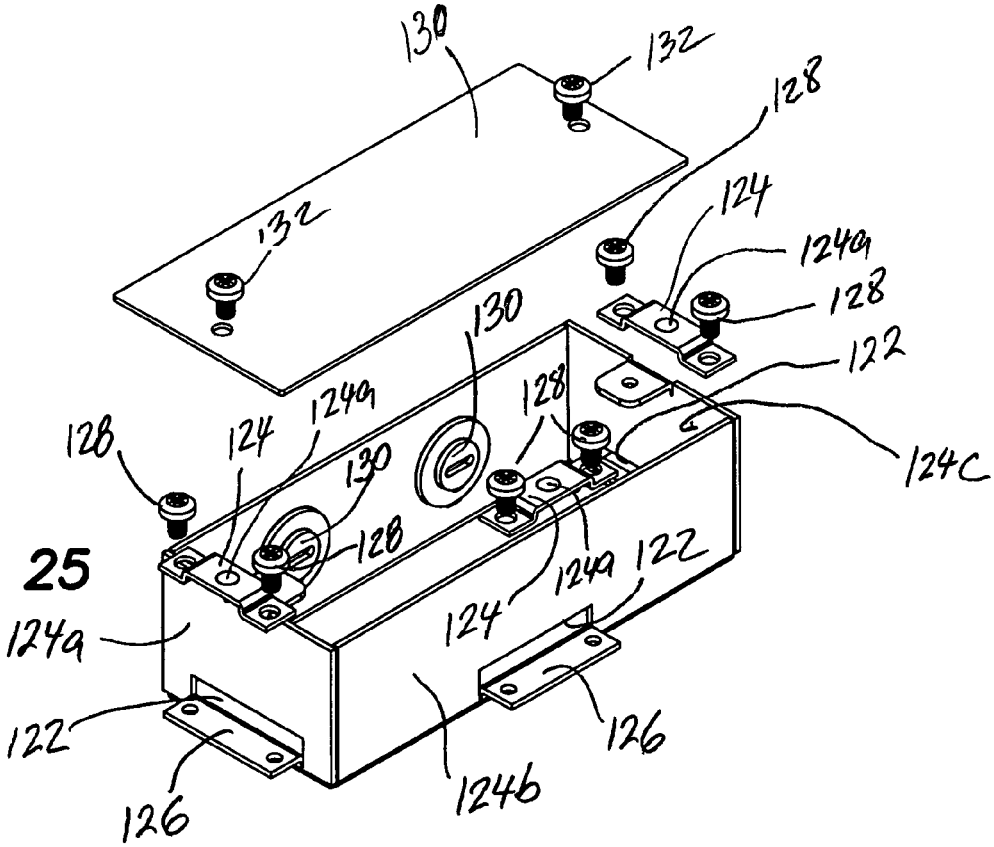
FIG. 25 is an exploded view of the junction box of FIG. 24.

FIGS. 24-25 show another junction box 120', where elements similar to those of box 120 in FIGS. 22-23 are designated by similar numerals. Box 120' is provided with three cable slots 122 in three box sides 124'*a,b,c* for admitting one, two or three cable 12 ends into the box. Each cable slot 122 is provided with a corresponding cable clamping arrangement analogous to that described in connection with FIGS. 22-23 and designated by similar numerals. Box 120 is useful, for example, for making L or T junctions between two or three cables 12 and for connecting electrical supply wires admitted-through knockouts 130 to such junctions.

While particular embodiments of the invention have been explained and illustrated for purposes of clarity and example, it must be understood that many changes, modifications and substitutions will become apparent to those having only ordinary skill in the art without thereby departing form the scope of the invention.

What is claimed is:

1. A lamp holder for festoon style lamps of the type having end contacts on opposite ends of a glass tubular lamp body, comprising:

a power distribution cable having parallel braided conductors in an insulating jacket; and a lamp socket having a thermoplastic unitary socket top and a unitary socket bottom adapted to make interlocking engagement with each other for capturing said cable therebetween, said socket top and said socket bottom being of approximately equal length along said cable;

a pair of contact holders on said unitary socket top, a lamp contact supported in each of said contact holders for holding therebetween a said festoon style lamp with a lamp axis generally parallel to said cable, said lamp contacts having piercing prongs projecting beneath said socket top for penetrating said insulating jacket thereby to electrically interconnect said lamp contacts with said braided conductors; and a generally planar metal heat shield plate covering said socket top between said contact holders under said festoon lamp for shielding said thermoplastic socket top against excessive heating by said lamp, and a curved light reflector interchangeable with said heat shield plate on said socket top.

2. The lamp holder of claim 1 wherein said heat shield plate is removably retained between opposite retainer prongs integral with said socket top and said light reflector is also retained between said retainer prongs interchangeably with said heat shield plate.

3. The lamp holder of claim 1 wherein said heat shield plate has a width substantially greater than said tubular body and a plate length approximately equal to said tubular body.

4. The lamp holder of claim 1 wherein said light reflector has a center portion between side portions, each of said side portions being detachable from said center portion.

5. The lamp holder of claim 1 further comprising a mounting lug configured to make releasable retentive engagement with a side edge of said socket bottom, said lug being perforated for passing a fastener for securing said lamp holder with said cable to a mounting surface, such that said lamp holder may be fastened directly to said mounting surface by means of said mounting lug or optionally inserted into a track without said mounting lug.

6. A strip lighting system comprising: a plurality of lamp sockets regularly spaced along a power cable and having piercing prongs for penetrating insulation of said power cable thereby to electrically interconnect said lamp sockets to a power source supplying conductors in said power cable, said power cable having a pair of conductors in an insulating jacket of relatively soft self-healing polyvinylchloride, said insulating jacket having a generally rectangular cross section with a cable width and a cable height smaller than said cable width, a cable top and a cable bottom, said conductors each comprised of flat rope braided 0.005 inch copper strands and having a generally rectangular cross section with a conductor width about 2.7 times a conductor height and said cable having an electrical resistance similar to that of AWG 10 stranded wire and a current rating of about 30 amperes, said cable width being about 4.5 times said conductor width, said cable height being about 2 times said conductor height, said conductors being spaced from each other by about one third said cable width, and a longitudinal slot of rectangular cross section with a slot bottom between parallel slot walls centered in each of said cable top and said cable bottom, each said longitudinal slot having a slot width of about 0.05 inch and a slot depth of about 0.025 inch, such that said cable can be folded over a cable length of about 3 inches to make a right angle turn by twisting said flat cable through about a forty five degree twist on each side of said turn to a fold line contained in a plane transverse to a common plane while keeping said cable substantially flat on said common plane on either side of said right angle turn and said cable is also foldable over itself through a right angle turn along a diagonal fold line generally parallel to said common plane.

7. The power cable of claim 6 wherein said conductors are flat rope braided comprising multiple braids each having multiple strands.

8. The power cable of claim 7 wherein each said conductor has about seven braids of about twenty four strands each.

9. The power cable of claim 6 wherein said conductors are each braided with about 168 strands.

10. The power cable of claim 6 wherein said conductor width and said conductor height are approximately 0.1350 inch and 0.05 inch respectively.

11. The power cable of claim 6 wherein said cable width is about 0.600 inch, said cable height is about 0.100 inch, each said longitudinal slot has a width of about 0.050 inch.

* * * * *